United States Patent [19]

Matsumoto et al.

[11] 4,156,476

[45] May 29, 1979

[54] NOISE CONTROL DEVICES

[75] Inventors: Masayasu Matsumoto, Zushi; Kazuyoshi Iida, Yokohama; Yoshikazu Kondo, Yokohama; Keiichiro Mizuno, Yokohama; Sadao Nomoto, Yokohama; Noriaki Murayama, Kawasaki; Tomonori Katayama; Keiichiro Tabata, both of Yokohama; Kenichi Onda, Tokyo, all of Japan

[73] Assignee: Bridgestone Tire Company Limited, Tokyo, Japan

[21] Appl. No.: 881,315

[22] Filed: Feb. 27, 1978

[30] Foreign Application Priority Data

Mar. 3, 1977 [JP] Japan ..... 52-22162

[51] Int. Cl.[2] ..... G10K 11/00; E04H 17/00

[52] U.S. Cl. ..... 181/210; 181/286; 181/288; 181/292; 104/124; 105/452

[58] Field of Search ..... 181/210, 224, 288, 286, 181/292, 293, 206; 105/452; 104/124; 256/13.1, 73

[56] References Cited

U.S. PATENT DOCUMENTS 3,113,634 12/1963 Watters ..... 181/224

*Primary Examiner*—L. T. Hix
*Assistant Examiner*—Benjamin R. Fuller
*Attorney, Agent, or Firm*—Sughrue, Rothwell, Mion, Zinn and Macpeak

[57] ABSTRACT

A noise control device which produces behind it an enlarged sound reducing region is disclosed. The device comprises a hollow structural body composed of a plurality of elongate hollow passages which are different in length and constructed such that the passage length is made the longest at a substantially center part in a vertical direction and is made gradually shorter from the center part toward upper and lower edges of the hollow structural body. The upper and lower edges allow direct propagation sound emitted from a noise source to pass thereover and therethrough.

2 Claims, 17 Drawing Figures

NOISE CONTROL DEVICES

BACKGROUND OF THE INVENTION

1. Field of the Invention

This invention relates to noise control devices and more particularly to a noise control device which is associated with a sound insulating wall or the like to significantly improve its sound reducing effect alleviating noise emitted from a noise source such as a railroad, highway or the like on which an electric car or automobiles operate.

2. Description of the Prior Art

Sound insulating walls and the like have been developed for the purpose of alleviating a public nuisance caused by various kinds of noises. In order to alleviate such noise, various measures for counteracting the effects of noise sources have been attempted. Such measures, however, have limits to their performance and are often difficult to implement.

For reducing noise, it has been the common practice to provide a barrier such as a sound insulating wall or the like and position it between a noise source and a noise receiving region for the purpose of intercepting propagation of the noise or to provide a barrier constructed to completely surround a noise source and shield it.

However, it is a matter of course that the former barrier is limited in its sound insulating effect, while the latter barrier requires other means such as a heat dissipation device, a ventilation device or the like and hence such barriers are complex in construction and difficult to. For insulating noise produced from vehicles such as a high speed electric car running on an elevated railroad or the like, use has been made of a sound insulating wall. That part of the noise which passes over the upper edge of the sound insulating wall and which is refracted in a sound shadow behind the sound insulating wall causes the sound insulating wall to reduce the noise by at most 20 dB. Particularly, a sound insulating wall provided at a position where one can see a noise source has substantially no effect.

In order to eliminate such disadvantages, attempts have been made to provide a shelter wall arranged along a railroad and surrounding the overall length thereof. But, such a shelter wall prevents houses adjacent thereto from being exposed to the sun, is expensive, requires a ventilation device, interrupts passenger's visual field, etc. and hence is difficult to use operationally.

The above mentioned problem has also been encountered with means for insulating noise produced from automobiles and from power driven units provided for industry.

SUMMARY OF THE INVENTION

An object of the invention, therefore, is to provide a noise control device which is simple in construction and can eliminate the above mentioned problem.

Another object of the invention is to provide a noise control device which not only can control noise but also can enlarge a sound reducing region where noise is significantly reduced.

A feature of the invention is the provision of a noise control device comprising a hollow structural body having a plurality of elongated hollow passages superimposed one upon the other and spaced apart from each other, said passages being arranged in a propagation direction of noise emitted from a noise source and adjacent passages located at least on a line perpendicular to said propagation direction being different in length from each other, characterized in that said hollow structural body is constructed such that said passage length is made the longest at a substantially center part in a vertical and is made gradually short from said center part toward upper and lower edges of said hollow structural body, and that said upper and lower edges allowing direct propagation sound emitted from said noise source to pass thereover and therethrough, said noise emitted from said noise source passing through said adjacent passages of different length and refracted by all of said passages and lagged in phase with respect to said direct propagation sound interfering with said direct propagation sound to produce an enlarged sound reducing region.

DETAILED DESCRIPTION OF THE INVENTION

The inventors have recognized by various experimental tests and by researchers that if a part of noise emitted from a noise source passes through a plurality of elongate hollow passages of a hollow structural body which are different in length and is refracted by all of the passages and lagged in phase with respect to direct propagation sound emitted from the noise source which is passed over the upper edge of the hollow structural body, the refracted propagation sound interferes with the direct propagation sound to produce a sound reducing region between the refracted propagation sound and the direct propagation sound. On the basis of the above mentioned recognition, the inventors have proposed a novel noise control device as described in U.S. Pat. No. 4,069,768. On the basis of additional experimental tests and research, the invention now provides an improved noise control device which can converge the refracted propagation noise into a point on an extension extending rearwardly from a substantially center part in a height direction of the hollow structural body, thereby producing upper and lower sound reducing regions behind the hollow structural body and hence significantly reducing noise.

Figure 1:
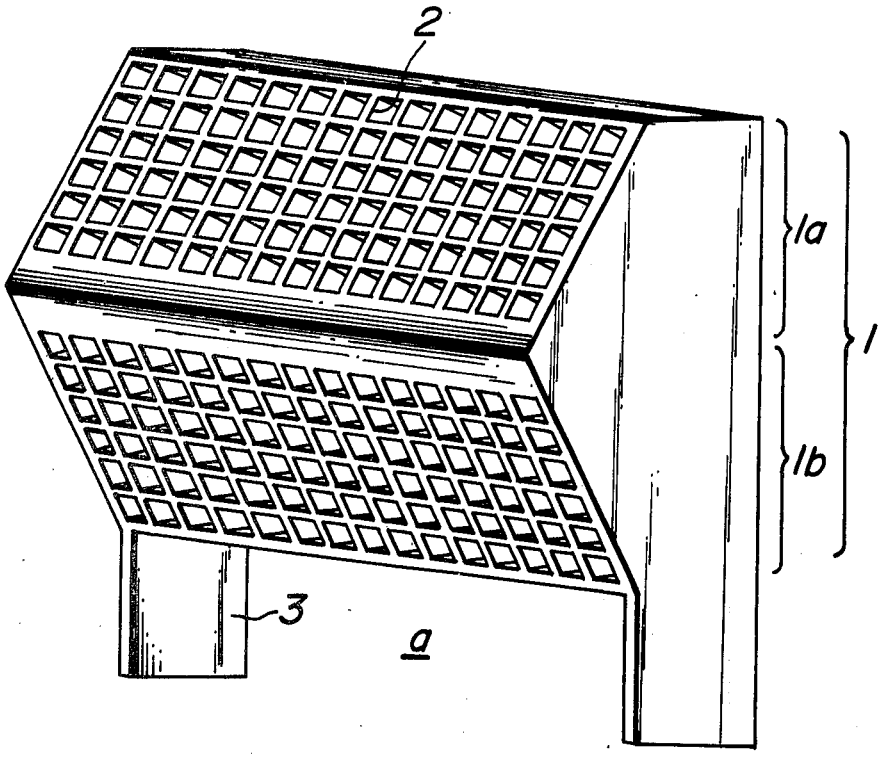
FIG. 1 is a perspective view of one embodiment of a noise control device according to the invention.

FIG. 1 shows one embodiment of a noise control device according to the invention. In the present embodiment, the device comprises a hollow structural body 1 having a plurality of elongated hollow passages 2 superimposed one upon the other and spaced apart from each other and legs 3 for supporting the hollow structural body 1 and forming a space a which allows a part of the noise emitted from a noise source to pass therethrough.

In the present embodiment, those hollow passages 2 which are arranged in an upper part 1*a* of the hollow structural body 1 are inclined downwardly, while those hollow passages 2 which are arranged in a lower part 1*b* of the hollow structural body 1 are inclined upwardly. In addition, the length of the hollow passages 2 is made the longest at a substantially center part in a vertical direction of the hollow structural body 1 and is made gradually shorter from the center part toward upper and lower edges of the hollow structural body 1.

In order to ascertain the presence of an enlarged sound reducing region produced by the noise control device constructed as described above according to the invention, the inventors have investigated a sound pressure distribution of noise emitted from a speaker in the absence and presence of the device according to the invention with the aid of a well known sound-light conversion device which when receiving a sound wave can produce an electric signal corresponding to the sound wave received and can turn a light emitting diode ON and OFF in response to the level of the electric signal produced to emit light.

Figure 2:
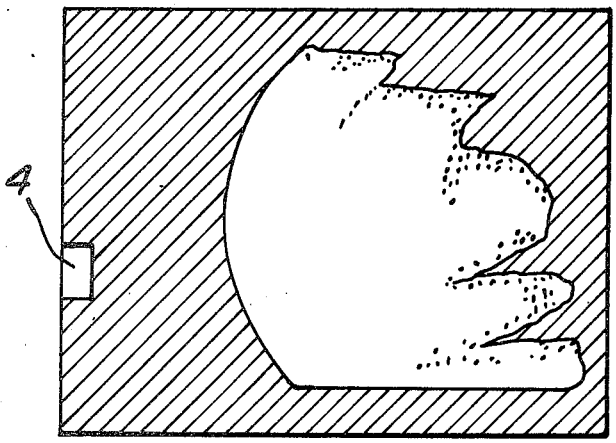
FIGS. 2 to 5 show sketches of photographs illustrating a principle of a noise control device according to the invention.

FIG. 2 shows a sketch of photograph taken by operating a camera for observing the ON and OFF conditions of the light emitting diode in response to the level of the electric signal corresponding to $\frac{1}{3}$ octave band noise having a center frequency of 2,000 Hz and emitted from a speaker 4 in the absence of the device according to the invention. In FIG. 2, a non-hatched portion represents a region having a sound pressure of higher than 60 phones, while a hatched portion represents a region having a sound pressure of lower than 60 phones.

Figure 3:
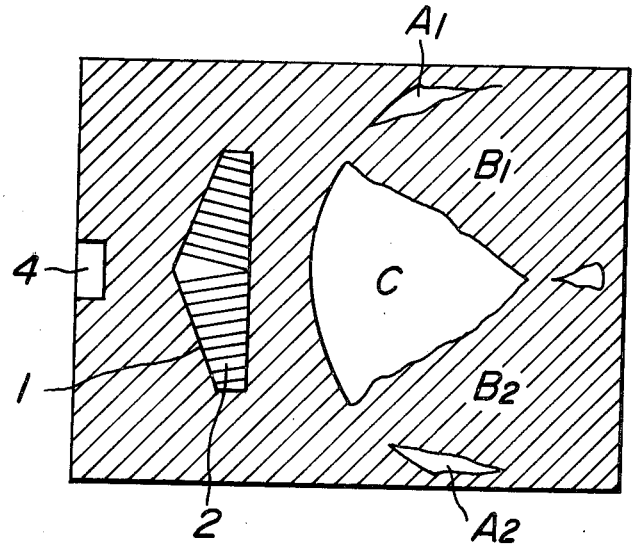

FIG. 3 shows a sketch of photograph taken by the same manner as in the case of FIG. 2 and illustrating a sound pressure distribution of $\frac{1}{3}$ octave band noise having a center frequency of 2,000 Hz and emitted from a speaker 4 in the presence of the device according to the invention.

As seen from FIG. 3, the presence of the device according to the invention causes a part of the noise emitted from the speaker 4 and passed through a plurality of elongate hollow passages 2 of the hollow structural body 1 to refract downwardly and upwardly with respect to upper and lower direct propagation sounds passing over the upper and lower edges of the device 1 without refraction to produce a sound reducing region $B_1$ located between an upper direct propagation sound region $A_1$ and a refracted propagation sound region C on the one hand and to produce another sound reducing region $B_2$ located between a lower direct propagation sound region $A_2$ and the refracted propagation sound region C on the other hand, thereby significantly reducing sound, the refracted propagation sound region C being converged to a point on an extension extending from a substantially center part in a vertical direction of the hollow structural body 1.

In order to investigate the phenomena shown in FIGS. 2 and 3, rare and dense conditions of a pure tone having a frequency of 2,000 Hz and emitted from the speaker 4 in the absence and presence of the device 1 according to the invention have been taken by photographs in the same manner as described above and illustrated by sketches in FIGS. 4 and 5.

Figure 4:
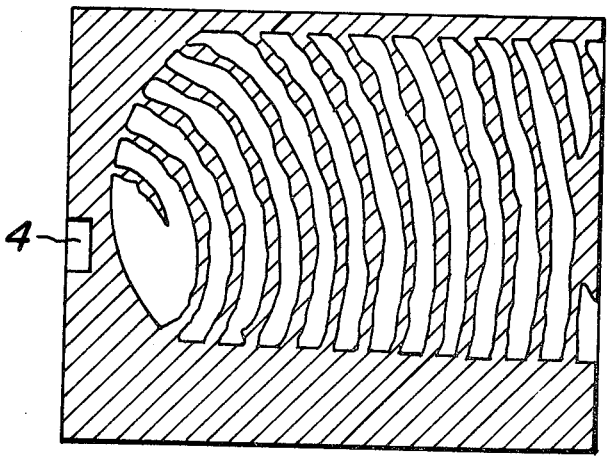
Figure 5:
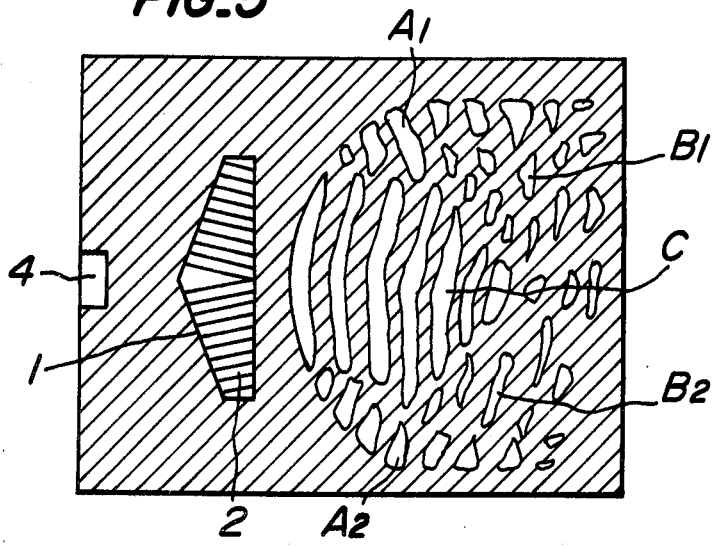
Figure 6:
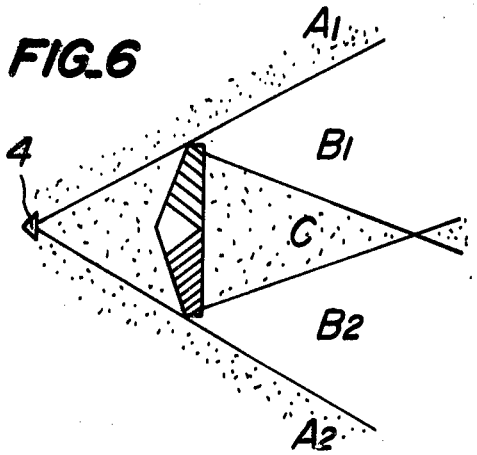
FIGS. 6 to 15 are diagrammatic views showing various embodiments of a noise control device according to the invention in section and respresentative patterns of direct sound propagation regions $A_1$, $A_2$, interference sound reducing regions $B_1$, $B_2$ and a refracted sound propagation region C, respectively.
Figure 7:
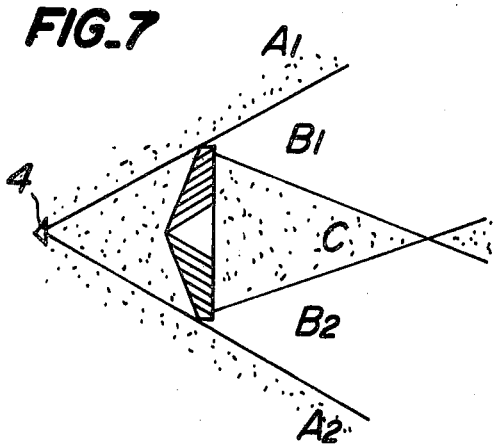
Figure 8:
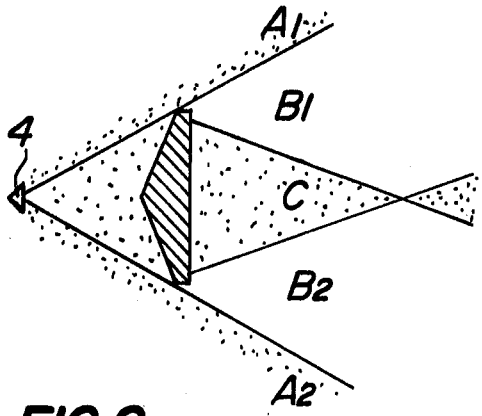
Figure 9:
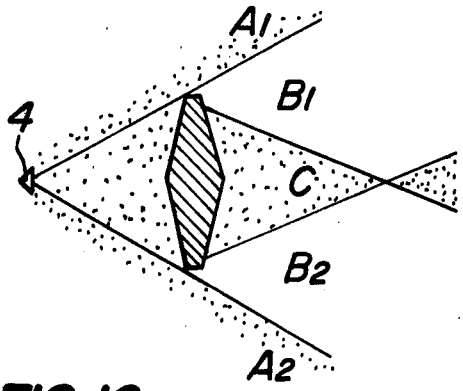
Figure 10:
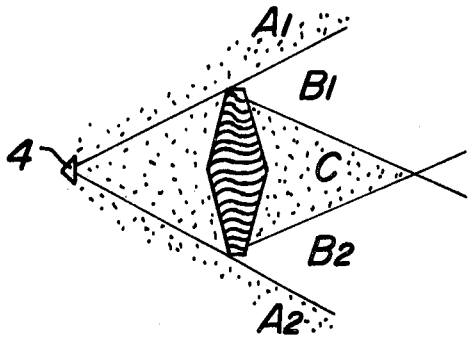
Figure 11:
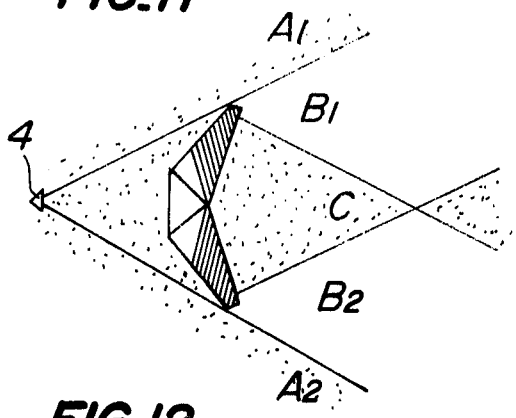

In FIGS. 4 and 5, non-hatched bright portions correspond to a dense condition of the sound wave, while a hatched dark portion corresponds to a rare condition thereof.

As seen from FIG. 4, the pure tone emitted from the speaker 4 is propagated in spherical waves with no phase lag. The presence of the device according to the invention, however, causes a sound wave passed through a plurality of elongated passages 2 and to be propagated in plane wave to refract downwardly and upwardly and lag in phase with respect to direct propagation sound passing over the upper and lower edges of the device and propagated in spherical wave. As a result, a refracted propagation region C converges to a point on an extension extending rearwardly from a substantially center part in a vertical direction of the device and wave fronts at the sound reducing regions $B_1$, $B_2$ located intermediate between direct propagation sound regions $A_1$, $A_2$ and the refracted propagation sound region C become discontinuous as shown in FIG. 5. These discontinuous wave fronts at the sound reducing regions $B_1$, $B_2$ show that a destructive interference phenomenon is produced resulting in the sound reducing regions $B_1$, $B_2$ shown in FIG. 3.

The inventors have further investigated the above mentioned sound reducing regions $B_1$, $B_2$ produced by the interference of the refracted propagation sound with the direct propagation sounds and effected experimental tests on a noise control device comprising a hollow structural bodies having of a plurality of elongated hollow passages which are different in length, angle of inclination and direction and shape relative to each other in order to determine critical relations among the noise source 4, direct propagation sound regions $A_1$, $A_2$, sound reducing regions $B_1$, $B_2$ and refracted propagation sound region C. These experimental tests have resulted in the demonstration of representative patterns of the refracted sound propagation region C, direct sound propagation regions $A_1$, $A_2$ and interference sound reducing regions $B_1$, $B_2$ shown in FIGS. 6 to 15.

As seen from FIGS. 6 to 15, if the outer configuration of the hollow structural body of the device according to the invention and the difference in length between adjacent passages are the same, the sound reducing regions $B_1$, $B_2$ are substantially the same in pattern irrespective of differences in the shape of the passages in section as shown in FIGS. 6 to 10. As a result, the sound reducing regions $B_1$, $B_2$ defined by the direction of refraction and the interference of the sound wave are determined by the size of the noise control device, the difference in length between adjacent passages and the position of the device relative to the noise source.

Figure 12:
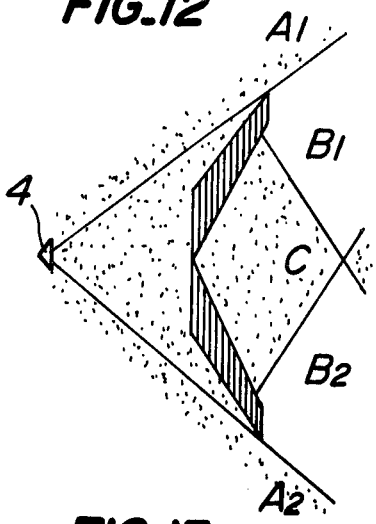
Figure 13:
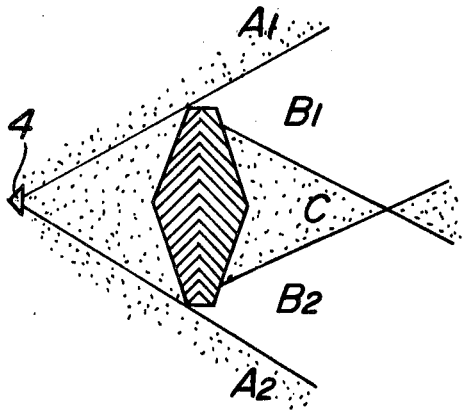
Figure 14:
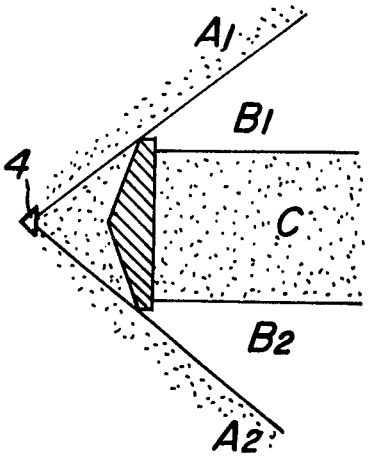
Figure 15:
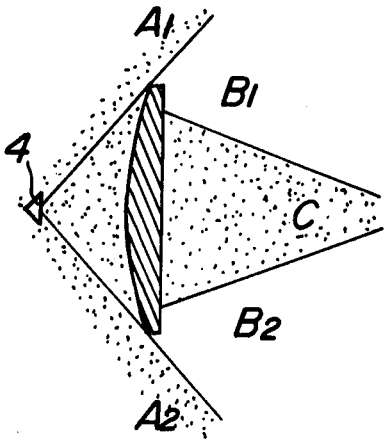

That is, the upper and lower boundary lines of the sound reducing regions $B_1$, $B_2$ are aligned with straight lines connecting the noise source 4 to the upper and lower edges of the device, while the lower and upper boundary lines of the sound reducing regions $B_1$, $B_2$ become inclined further downwardly and upwardly, that is, the focal distance becomes shortened as the difference in length between adjacent elongated hollow passages 2, 2 of the hollow structural body 1 becomes larger as shown in FIGS. 12 and 13. As a result, the direct propagation sound regions $A_1$, $A_2$, the refracted propagation sound region C and the interference sound reducing regions $B_1$, $B_2$ may be produced at any positions by suitably selecting the size of the device according to the invention, the difference in length between adjacent elongated hollow passages 2, 2 of the hollow structural body 1 and the relative position of the noise source 4. It is also possible to make the refracted propagation sound region C parallel with the noise propagation direction as shown in FIG. 14.

The sound reducing effect of the noise control device according to the invention will now be described with reference to an experimental test example.

Figure 16:
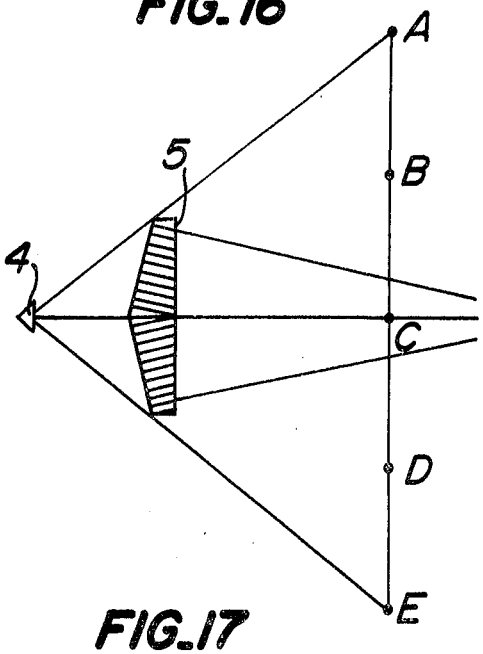
FIG. 16 is a diagrammatic view showing an experimental test apparatus in the device according to the invention.

As shown in FIG. 16, noise having a center frequency of 1,000 Hz was emitted from a speaker 4 and the sound pressure level in dB was measured at sound receiving points A, B, C, D, E located on a line perpendicular to an extension of a line connecting the speaker 4 to the center part in the vertical direction of the hollow structural body. The measurement was effected in the presence and absence of the device 5 and produced the data shown in the following table 1.

The distance between the speaker 4 and the sound receiving point C located on the extension drawn from the speaker 4 and passing through the center part of the hollow cylindrical body 5 was 3 m.

Table 1

| | (Unit dB) | | | | |
|---|---|---|---|---|---|
| | A | B | C | D | E |
| Absence of Device 5 | 85 | 88 | 90 | 87 | 85 |
| Presence of Device 5 | 85 | 78 | 91 | 75 | 84 |

As seen from the above table 1, the sound pressure level at the sound receiving points A, E located in the direct propagation sound regions where the noise reached without passing through the device 5 is substantially the same irrespective of the presence or absence of the device 5. The sound pressure level at the sound receiving point C located in the refracted propagation sound region becomes higher owing to the presence of the device 5.

The sound pressure level at the sound receiving points B, D located in the regions where the direct propagation sound, which has not passed through the device 5 interferes with the refracted propagation sound which has passed through the device 5, is significantly reduced owing to the presence of the device 5.

Figure 17:
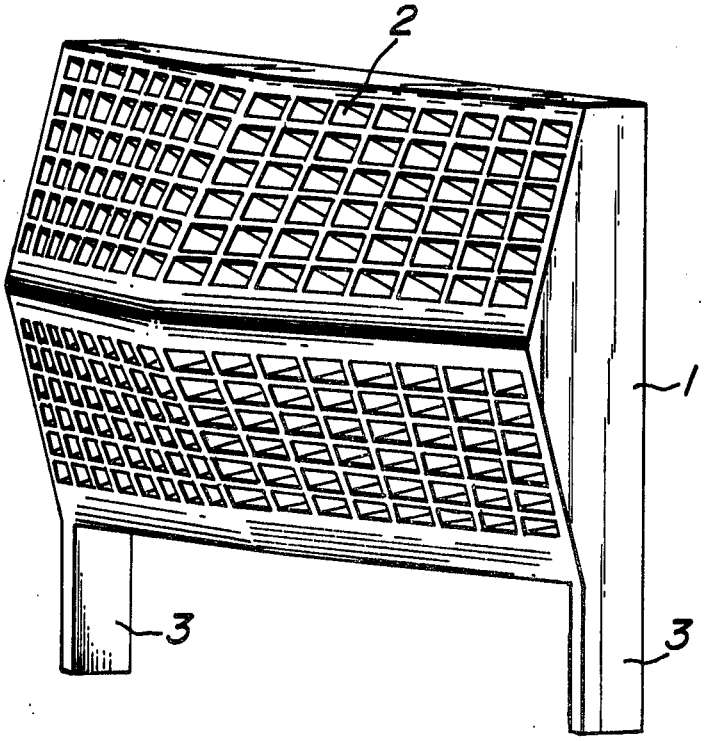
FIG. 17 is a perspective view of another embodiment of a noise control device according to the invention.

FIG. 17 shows another embodiment of a noise control device according to the invention. In the present embodiment, the hollow structural body 1 is so constructed that the length of a plurality of elongated hollow passages 2 superimposed one upon the other and spaced apart from each other is not only made the longest at a substantially center part in a vertical direction of the hollow structural body 1 and is made gradually shorter from the center part toward the upper and lower edges of hollow structural body, but also made the longest at the center part in a lengthwise direction of the hollow structural body 1 and is made gradually shorter from the center part toward the left and right edges of the hollow structural body 1.

In the noise control device constructed as described above, the direct propagation sound emitted from the noise source and passed over the upper and lower edges as well as the left and right edges of the hollow structural body 1 not only propagate upwardly and downwardly but also propagate leftwardly and rightwardly. But, the sound wave which has passed through the adjacent passages of different length is refracted by all of the passages and lags in phase with respect to the direct propagation sound and hence is converged to a point located on an extension extending rearwardly from a substantially center of the hollow structural body 1, thereby producing an enlarged sound reducing region behind the device.

As a result, a number of the noise control devices shown in FIG. 17 may be arranged along a noise source such as a railroad, highway or the like on which an electric car or automobiles run and spaced apart from each other without degrading the sound reducing effect. Thus, it is possible to install the devices in a significantly easy manner.

What is claimed is:

1. A noise control device comprising a hollow structural body having a plurality of elongate hollow passages superimposed one upon the other and spaced apart from each other, said passages being open at each end and arranged in a propagation direction of noise emitted from a noise source in front of the device and adjacent passages being different in length from each other, characterized in that said hollow structural body is constructed such that said passage length is the longest at a substantially center part in a vertical direction of said hollow structural body and is made gradually shorter from said center part toward upper and lower edges of said hollow structural body, that said passages are disposed at an angle to the direction of sound propagation, and that said upper and lower edges alow direct propagating sound emitted from said noise source to pass freely thereover and therethrough, noise emitted from said noise source passing through said adjacent passages of different length and being refracted by all of said passages and lagged in phase with respect to sound propagating directly from said noise source interfering with said directly propagating sound to produce a sound reducing region.

2. The device according to claim 1, wherein said passage length is made the longest at substantially a center part in a lengthwise direction of said hollow structural body and is made gradually shorter from said center part toward left and right edges of said hollow structural body, said left and right edges allowing said direct propagation sound to pass thereover.

* * * * *